United States Patent [19]

Bullard et al.

[11] Patent Number: 4,842,421

[45] Date of Patent: Jun. 27, 1989

[54] THERMOPLASTIC DRAW TAPE BAG WITH TACKY CLOSURE SURFACE

[75] Inventors: Edward M. Bullard, East Rochester; Fox J. Herrington, Holcomb, both of N.Y.

[73] Assignee: Mobil Oil Corporation, New York, N.Y.

[21] Appl. No.: 195,919

[22] Filed: May 19, 1988

[51] Int. Cl.[4] ..... B65D 33/20; B65D 33/28

[52] U.S. Cl. ..... 383/61; 383/74; 383/75; 383/95; 493/225

[58] Field of Search ..... 383/72, 73, 74, 75, 383/76, 61, 95; 493/225

[56] References Cited

U.S. PATENT DOCUMENTS 916,802 3/1909 Thompson ..... 383/74

1,095,790 5/1914 Blumel ..... 383/74

2,524,030 10/1950 Allen ..... 383/61

3,119,549 1/1964 Schoen ..... 383/75

*Primary Examiner*—Stephen P. Garbe

*Attorney, Agent, or Firm*—Alexander J. McKillop; Charles J. Speciale

[57] ABSTRACT

A thermoplastic draw tape bag having a tacky surface on the inside lip of the mouth of the bag and extending around the inner periphery of the lip on the open mouth of the bag, the surface comprising a material having the characteristic of sticking to itself and being adapted to seal the open mouth and hold the bag closed after the draw tape is pulled tight. In one form of the invention, the tacky surface comprises a coating of glycerol monooleate. The surface may also comprise a layer of polyvinylidene chloride or a layer of polyisobutylene.

4 Claims, 1 Drawing Sheet

THERMOPLASTIC DRAW TAPE BAG WITH TACKY CLOSURE SURFACE

FIELD OF THE INVENTION

The invention relates to the manufacture of flexible bags and particularly to the manufacture of draw tape bags from thermoplastic films wherein the bags are held closed without tying the draw tapes.

BACKGROUND OF THE INVENTION

Bags made of plastic film such as thin polyethylene film have been used in various sizes. Small bags are used in the packaging of sandwiches and the like; larger bags are used for shopping bags and even larger bags are used for containing trash. The present invention is particularly related to a draw tape bag having a tacky closure surface.

A particularly advantageous closure for such bags includes a draw band or tape constructed from the same polyethylene material. Draw tape bags of this type have been known for several years and are described in various patents such as, for example, U.S. Pat. No. 3,029,853—Piazze. Bags of this type are formed by two pliable plastic sheets joined to one another on three sides and open at a fourth. The tubular hem is provided at the open end of each sheet and contains a pliable thermoplastic strip. A hole or opening at the center of each hem exposes the strip in the hems allowing them to be pulled through the opening and used as a handle while simultaneously closing the open mouth of the bag. A similar type bag is disclosed in U.S. Pat. No. 4,624,654—Boyd et al. Draw tapes in the bags disclosed in these patents are at the same level in both hems of the bag. Draw tape bags using two tapes at different parallel levels in the bags are disclosed in U.S. Pat. No. 3,547,341—Kirkpatrick and U.S. Pat. No. 3,738,568—Ruda. In both of these patents the openings for pulling the draw tapes are at the opposite ends of the bag.

The present invention is also applicable to bags of the types disclosed in Broderick et al application Ser. No. 100,648, filed Sept. 24, 1987 entitled "Dual Draw Tape Bag and Method of Manufacture", Broderick et al application Ser. No. 100,649, filed Sept. 24, 1987 entitled "Draw Tape Bag with Two Single Tapes" and Broderick et al application Ser. No. 115,308, filed Nov. 2, 1987, entitled "Draw Tape Bag with Two Single Wraparound Draw Tapes and Method of Manufacture", all assigned to the assignee of the present application and incorporated herein by reference thereto.

RELATED APPLICATIONS

The present invention is related to the invention disclosed in Herrington application Ser. No. 07/195,920 entitled "Thermoplastic Draw Tape Bag Held Closed by Microencapsulated Adhesive", and the invention disclosed in Herrington application Ser. No. 07/195,921, entitled "Thermoplastic Draw Tape Bag with Tacky Tape" all assigned to the assignee of the present application and concurrently filed herewith and incorporated herein by reference thereto.

It is an object of the present invention to provide a thermoplastic draw tape bag in which the bag is held closed by a tacky surface on the inside lip at the top of the bag and extending around the inner periphery of the lip at the top of the bag, the tacky surface comprising a material having the characteristic of sticking to itself and being adapted to seal the open mouth and hold the bag closed after the draw tape is pulled tight. There is no need to tie the tapes and the bags are more easily re-openable than with tied tapes.

SUMMARY OF THE INVENTION

In accordance with the present invention, there is provided a thermoplastic draw tape bag comprising two panels forming an open top, closed bottom bag, the panels being joined along the sides of the bag, a hem on the panels being folded over adjacent the top to form an open mouth for the bag, the bottom of the hem being secured to the adjacent panel, a draw tape in each hem secured at the side of the panels, each draw tape being accessible for pulling through an opening in the respective hem of the bag and a tacky surface on the inside lip of the mouth of the bag and extending around the inner periphery of the lip on the open mouth of the bag, the surface comprising a material having the characteristic of sticking to itself and being adapted to seal the open mouth and hold the bag closed after the draw tape is pulled tight. The tacky surface in one embodiment of the invention comprises a coating of glycerol mono-oleate. In another embodiment of the invention the tacky surface comprises a layer of polyvinylidene chloride. In another embodiment of the invention the tacky surface comprises a layer of polyisobutylene.

The foregoing and other features and advantages of the invention will be better understood from the following more detailed description and appended claims.

DESCRIPTION OF THE PREFERRED EMBODIMENT

The plastic draw tape bags of the present invention may be made of any suitable thermoplastic material such for example as high density polyethylene or from linear low density polyethylene or equivalent plastic materials. In the preferred form of the invention the bags are formed from a tube of polyethylene which is oriented in a direction of extrusion. Such materials for plastic bags are disclosed in U.S. Pat. No. 4,558,463—Boyd. Apparatus suitable for manufacturing draw tape bags of the present invention is disclosed in U.S. Pat. 4,625,654—Boyd et al and the disclosure therein is incorporated herein by reference thereto.

Figure 1:
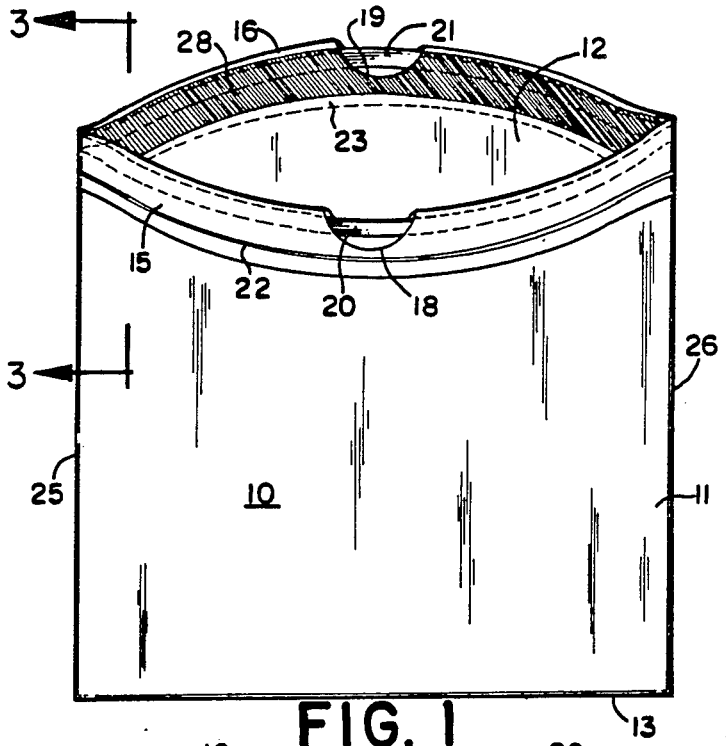
FIG. 1 is a perspective view of a draw tape bag with tacky closure surface embodying the present invention.
Figure 2:
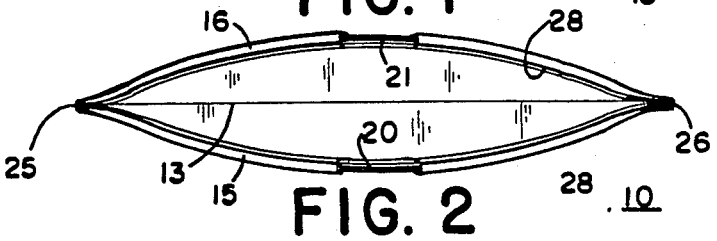
FIG. 2 is a top plan view of the bag shown in FIG. 1.
Figure 3:
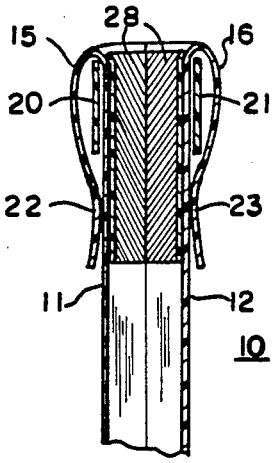
FIG. 3 is a sectional view taken along the lines 3—3 in FIG. 1.

Referring to FIGS. 1–3 it will be seen that a draw tape bag 10 according to the present invention includes a front panel 11 and a rear panel 12. The two panels are preferably formed from a tube of polyethylene which is oriented in the direction of extrusion. The bottom 13 of the bag 10 may be formed by a fold or heat seal joining the front and back panels 11 and 12. The tube is slit along the top and the two longitudinal free edges are folded over respectively against the adjoining panels 11 and 12 to provide an open mouth comprising a pair of longitudinal hems 15 and 16 of double layer thickness opposite the longitudinal fold edge of bottom 13. As shown in FIGS. 1 and 2 the hems 15 and 16 are provided with openings or holes 18 and 19 for access to the draw tapes 20 and 21 inserted in the respective hems.

After the draw tapes 20 and 21 have been inserted in the respective hems 15 and 16, the double layer thickness of each hem is longitudinally joined together along seal lines 22 and 23 to form opposed tubular channels each containing one of the draw tapes 20 and 21 respectively. The ends of the draw tapes 20 and 21 are secured to the respective sides of the bag 10 when the side heat seals 25 and 26 are made.

As may be seen in FIGS. 1 and 2 a tacky coating or surface 28 is applied to the inside lip at the top of the bag and this tacky surface extends around the inner periphery of the lip at the top of the bag. The surface 28 comprises a material having the characteristic of sticking to itself and being adapted to seal the open mouth and hold the bag closed after the draw tape tapes 20 and 21 are pulled tight. The surface 28 in one form of the invention may comprise a coating of glycerol mono-oleate. As an alternative the surface 28 may comprise a layer of polyvinylidene chloride sold under the trademark Saran Wrap or the surface 28 may comprise a layer of a sticky polymer such as a layer of polyisobutylene. The surface 28 is shown on enlarged scale in FIG. 3 for emphasis. It is to be understood that the tacky surface 28 may comprise other equivalent materials so long as they have the characteristic of sticking to itself and being adapted to seal the open mouth and hold the bag closed after the draw tape is pulled tight. Thus the need to tie the tapes is eliminated and the bags are more easily reopenable then with tied tapes.

While the draw tape bag illustrated in the drawing is of the type having an opening in the hem intermediate the ends of the hem it is to be understood that the present invention is applicable to other types of draw tape bags where the opening in the hem may be located at the ends of the hem rather than intermediate the ends of the hem.

What is claimed is:

1. A thermoplastic draw tape bag comprising:

two panels forming an open top, closed bottom bag, said panels being joined along the sides of said bag;

a hem on said panels being folded over adjacent said top to form an open mouth for said bag, the bottom of said hem being secured to the adjacent panel;

a draw tape in each hem secured at the side of said panels, each said draw tape being accessible for pulling through an opening in the respective hem of said bag; and a tacky surface on the inside lip of the mouth of the bag and extending around the inner periphery of said lip on said open mouth of the bag, said surface comprising a material having the characteristic of sticking to itself and being adapted to seal the open mouth and hold the bag closed after the draw tape is pulled tight.

2. A draw tape bag according to claim 1 wherein said tacky surface comprises a coating of glycerol mono-oleate.

3. A draw tape bag according to claim 1 wherein said tacky surface comprises a layer of polyvinylidene chloride.

4. A draw tape bag according to claim 1 wherein said tacky surface comprises a layer of polyisobutylene.

* * * * *